United States Patent [19]

Rassey

[11] 4,198,946

[45] Apr. 22, 1980

[54] ROTARY VALVE CONSTRUCTION FOR AN INTERNAL COMBUSTION ENGINE

[76] Inventor: Louis J. Rassey, 29048 Gloede, Warren, Mich. 48093

[21] Appl. No.: 803,051

[22] Filed: Jun. 3, 1977

[51] Int. Cl.[2] ..... F01L 7/00

[52] U.S. Cl. ..... 123/190 E; 123/190 A; 123/41.4

[58] Field of Search ..... 123/41.4, 51 A, 190 A, 123/190 DL, 190 E, 190 BB, 190 BD, 80 BA

[56] References Cited

U.S. PATENT DOCUMENTS

| | | | |
|---|---|---|---|
| 1,098,411 | 6/1914 | Schmidt | 123/41.4 |
| 1,245,257 | 11/1917 | Miller et al. | 123/190 A |
| 1,353,289 | 9/1920 | Stokes | 123/190 A |
| 1,354,772 | 10/1920 | Maulis | 123/190 E |
| 1,365,531 | 1/1921 | Moses | 123/190 BB |
| 1,515,052 | 11/1924 | Johnson | 123/190 A |
| 1,545,205 | 7/1925 | Shaw | 123/41.4 |
| 1,671,254 | 5/1928 | Porter | 123/190 E |
| 1,671,255 | 5/1928 | Porter | 123/190 E |
| 1,699,852 | 1/1929 | Moravec | 123/190 BB |
| 2,320,928 | 6/1943 | Henson | 123/51 A |
| 3,989,025 | 11/1976 | Franco | 123/190 E |
| 4,019,487 | 4/1977 | Guenther | 123/190 E |

*Primary Examiner*—Charles J. Myhre

*Assistant Examiner*—David D. Reynolds

*Attorney, Agent, or Firm*—Gifford, Chandler, VanOphem, Sheridan & Sprinkle

[57] ABSTRACT

An improved rotary valve construction is provided for use in conjunction with an internal combustion engine of the type having a housing and at least one piston member reciprocally received within a cylinder formed in the housing. In the conventional fashion, fuel intake passage means formed within the housing communicate a combustible fuel mixture to the cylinder while, likewise, exhaust passage means formed in the engine housing expel exhaust gases from the cylinder. A first and second cylindrical valve member, each having a diametric throughbore, are rotatably mounted in the intake passage means and exhaust passage means, respectively. The valve members are rotatably driven in synchronism with the reciprocation of the piston in the cylinder to thereby open the intake and exhaust passage means via the valve member diametric bore at predetermined rotational positions of the valve members. Each valve member further includes at least one axial fluid passageway which is fluidly connected at both ends to the fluid coolant system of the internal combustion engine so that a flow of coolant axially through both valve members is obtained.

14 Claims, 6 Drawing Figures

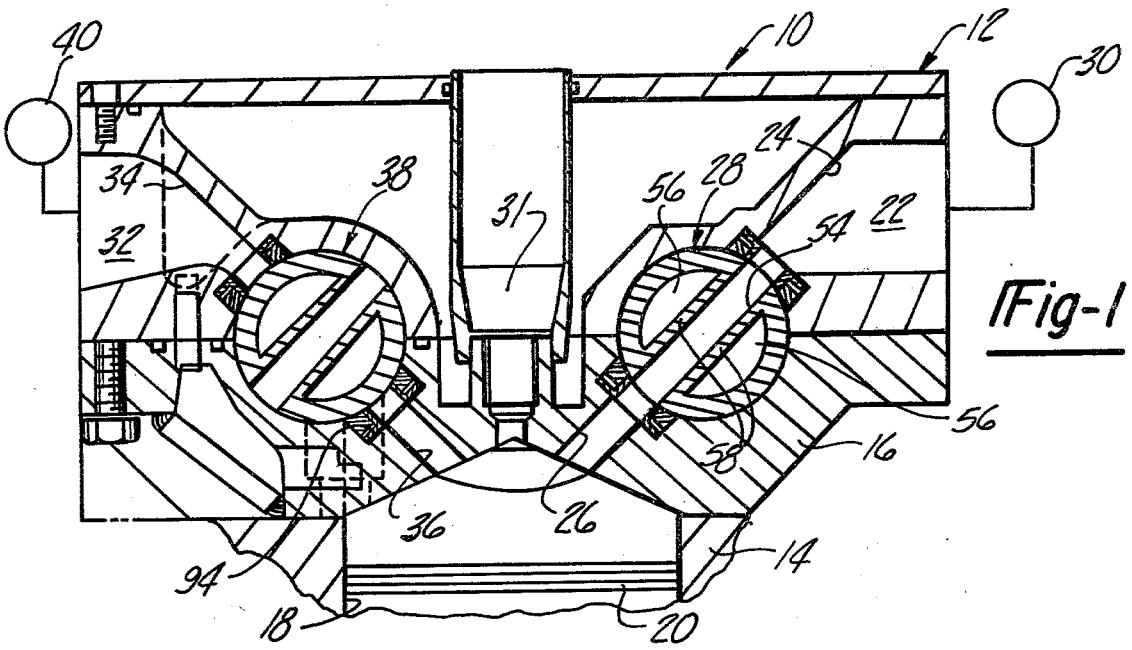
Fig-1
Fig-3
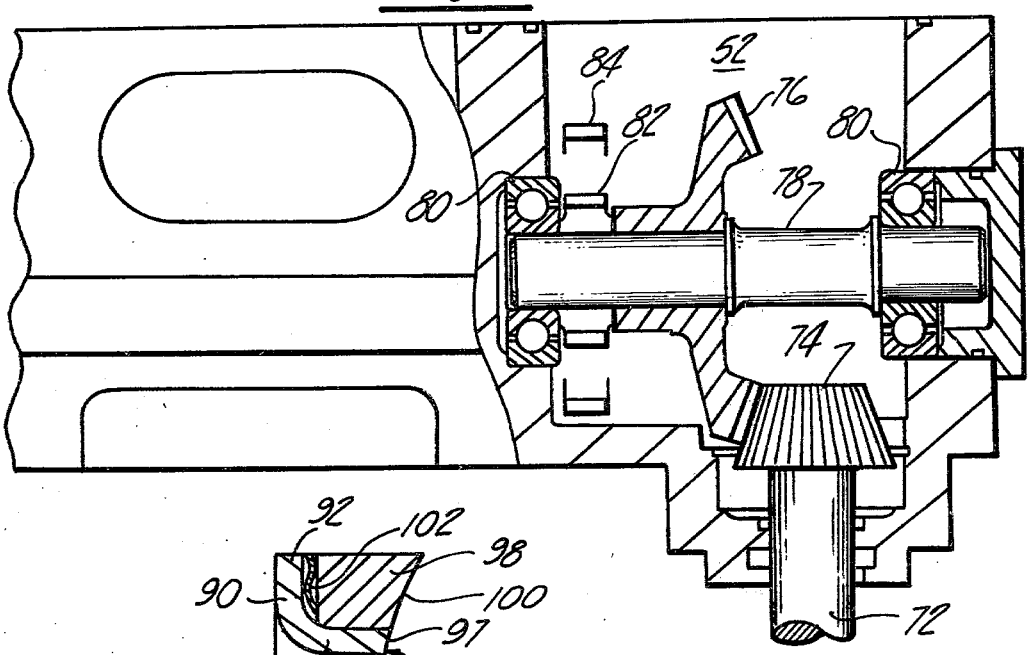
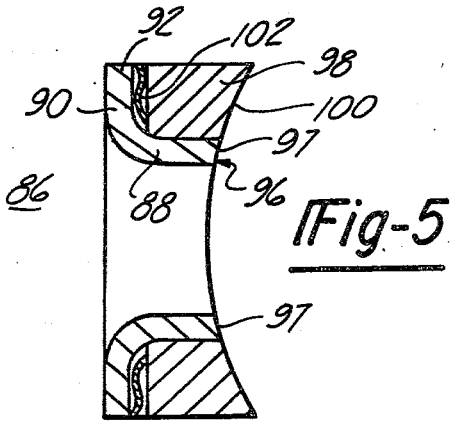
Fig-5

ROTARY VALVE CONSTRUCTION FOR AN INTERNAL COMBUSTION ENGINE

BACKGROUND OF THE INVENTION

I. Field of the Invention

The present invention relates generally to internal combustion engines and, more particularly, to an improved rotary intake and exhaust valve construction.

II. Description of the Prior Art

Conventional internal combustion engines include a housing with at least one piston member reciprocally mounted within a cylinder formed in the housing. Fuel intake passage means formed in the housing supply fuel to the cylinder for combustion while, similarly, the exhaust gases from the cylinder pass through exhaust passage means formed in the housing and to the engine exhaust system.

In order to permit the intake of fuel into the cylinder and the expulsion of exhaust gases from the cylinder at the desired engine cycles, an intake valve and an exhaust valve are provided in the intake and exhaust passage means, respectively. These valves permit fluid flow or communication through their respective passage means upon opening and, conversely, when closed prohibit such fluid flow.

There are many different types of previously-known intake and exhaust valves. One type of previously-known valve member employs a circular closure plate with an axially attached elongated stem. The plate cooperates with a valve seat formed in the housing while a spring attached to the elongated stem normally urges the valve to its closed position. Conversely, opening of the valve is accomplished by depression of the valve stem by a cam, rocker arm, or other appropriate means. This simple type of engine valve, however, is disadvantageous due to its high cost which, in turn, results primarily from the multiplicity of components required for the valve and its actuation. Moreover, these previously-known engine valve systems are both heavy and bulky in construction.

A rotary engine valve forms another previously-known engine valve in which an elongated cylindrical valve member is rotatably mounted within the engine housing in the fuel intake or exhaust passage means for at least one, and preferably several, engine cylinders. Diametric throughbores are provided through the cylindrical valve member so that upon rotation in synchronism with the internal combustion engine, the valve members permit fluid flow through the intake or exhaust passage means via the diametric throughbore at preselected rotational positions of the valve member. These previously-known engine rotary valves are advantageous over other types of engine valves in that the rotary valves are relatively inexpensive to construct and install. The previously-known rotary valves are additionally advantageous in that such valves are compact and lightweight in construction.

Despite the advantages of the rotary valve, such valves have not enjoyed wide-spread use or acceptance in the industry. One reason for this is that the rotary valves, and particularly the exhaust valve, are subjected to high temperatures from the engine cylinders and tend to warp when overheated. Warpage of the rotary valve not only disables the engine, but also requires expensive replacement of the valve.

A still further disadvantage of these previously-known rotary valves is that the valves must be journalled in high temperature precision bearings. Such bearings are almost prohibitively expensive, but nevertheless required to withstand the normal operating temperatures to which the rotary valve is subjected.

A still further disadvantage of these previously-known rotary valves is that no previously-known sealing means has been heretofore known for adequately sealing the rotary valve to the engine housing particularly after long usage. Consequently, these previously-known rotary valves suffer from fluid leakage around the valves which in turn causes engine compression loss and carburetor blow-back.

SUMMARY OF THE PRESENT INVENTION

The present invention overcomes the above-mentioned disadvantages of the previously-known rotary engine valves by providing such a valve with internal cooling and improved sealing means between the engine housing and the rotary valve.

In brief, the rotary valves according to the present invention are both elongated and cylindrical in shape with one valve disposed through the inlet and the other through the exhaust passage means in the engine housing. Each rotary valve is rotatably journalled in its respective passage means and includes a diametric opening for each passageway in the passage means. Consequently, upon rotation, the rotary valve establishes fluid communication through passageways via the diametric openings at predetermined rotational positions of the rotary valve.

In addition to the diametric openings, however, the rotary valve of the present invention further includes at least one axial passage formed therethrough. One end of the axial passage is coupled to a source of pressurized coolant, typically the output from the vehicle water pump, while the other end of the axial passage is fluidly coupled to a fluid return, typically the radiator inlet. By this arrangement, constant coolant flow is provided axially through the rotary valve which prevents overheating of the valve.

The present invention also discloses a novel means for rotatably driving the rotary valve. In particular, a rotatably mounted shaft is coupled directly to the engine crankshaft by an appropriate gearing arrangement while the other end of the shaft is coupled by a suitable gearing arrangement to both the intake and exhaust rotary valves. This driving means thus replaces the previously-known chain-driven overhead arrangement along with the cost and the weight of these previously-known valve driving means.

The present invention also teaches a novel means for sealing the rotary valve to the engine housing. In brief a self-lubricating graphite member is disposed between the valve member and the engine housing. A spring washer in turn urges the graphite member against the rotary valve with a force sufficient to provide a sealing engagement between the graphite member and the rotary valve, but insufficient to adversely inhibit the rotation of the valve member.

As will be more fully understood as the description proceeds, the rotary valve of the present invention is of simple, lightweight, and inexpensive construction. Moreover, due to the axial cooling passages formed through the rotary valve, the valve can be directly and effectively cooled which in turn permits the use of relatively inexpensive bearing assemblies to rotatably journal the rotary valve rather than the previously-known expensive, high temperature bearing assemblies.

BRIEF DESCRIPTION OF THE DRAWING

The present invention will be more clearly understood upon reference to the following detailed description when read in conjunction with the accompanying drawing, wherein like reference characters refer to like parts throughout the several views, and in which:

FIG. 1 is a fragmentary sectional view showing the rotary valve construction of the present invention in an engine housing;

FIG. 3 is a fragmentary, partial sectional view showing the means for rotatably driving the rotary valve of the present invention and enlarged for clarity;

FIG. 5 is a cross-sectional view illustrating a seal member for sealing the rotary valve to the engine housing and enlarged for clarity.

DETAILED DESCRIPTION OF THE PRESENT INVENTION

Figure 2:
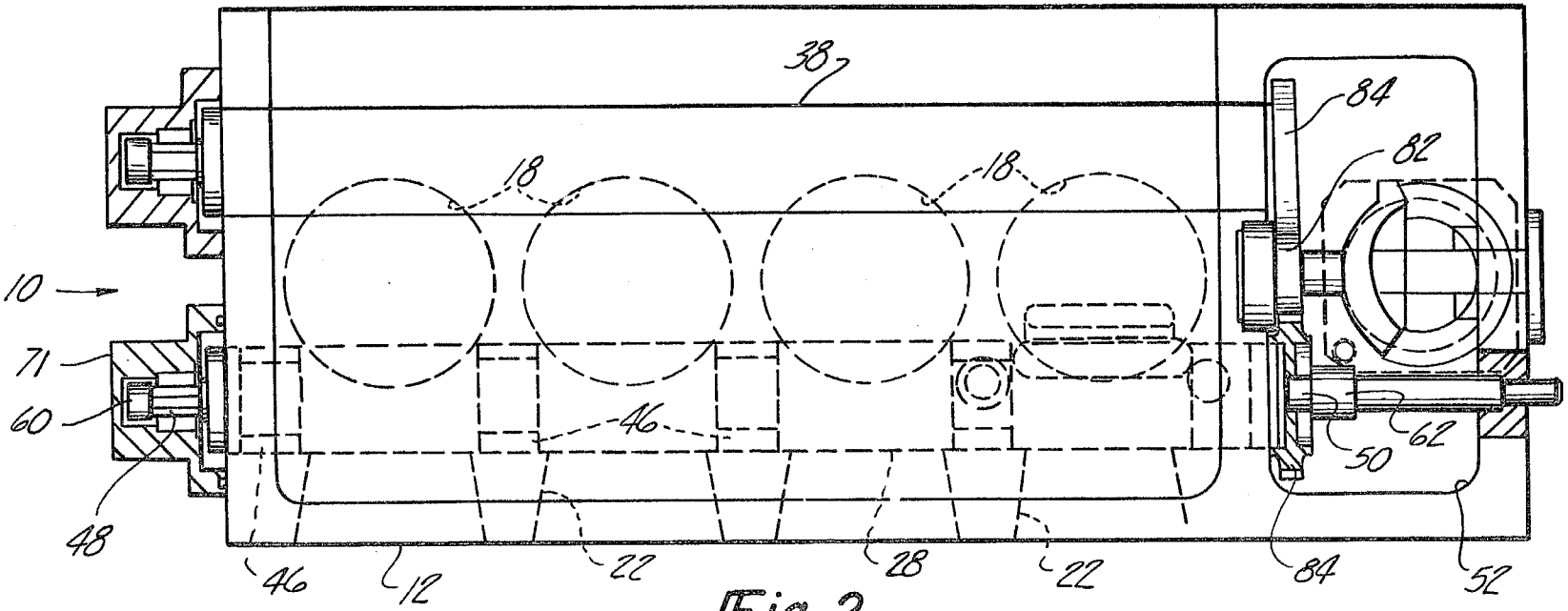
FIG. 2 is a fragmentary, partial sectional top view illustrating an internal combustion engine employing the rotary valve of the present invention.

With reference first to FIGS. 1 and 2, a portion of an internal combustion engine 10 is thereshown having a housing 12. The housing 12 further comprises a block 14 and an upper head assembly 16 detachably connected by means, not shown, to the engine block 14. Typically, the engine valve means which will subsequently be described in greater detail, are contained within the head assembly 16 while one or more cylinders 18 are formed within the engine block 14 and adapted to reciprocally receive a piston member 20 therein. Each piston member 20 in turn is connected at its lower end to a crankshaft (not shown) by appropriate piston rod means (not shown). Moreover, by way of example only, the internal combustion engine 10 shown in FIGS. 1–4 of the drawing incorporates four in-line cylinders 18, it being understood, of course, that the provision of more or less cylinders 18 remains within the scope and spirit of the invention.

A fuel intake passage means 22 comprising a first section 24 and a second section 26 is formed through the head assembly 16 with a rotary intake valve 28, according to the present invention, disposed between the intake passage sections 24 and 26. The passage section 24 is coupled at its outer end to appropriate carburetor means 30 while the inner end of the passage section 26 is open to the cylinder 18. Thus, with the valve 28 in its open position, the piston 20 inducts a fuel mixture from the carburetor means 30 into the cylinder 18 during the conventional downward intake cycle of the piston 20. Conventional ignition means 31 are provided for igniting the fuel mixture in the cylinder 18.

Exhaust passage means 32 comprising a first section 34 and a second section 36 are also formed through the head assembly 16 with a rotary exhaust valve 38 according to the present invention, disposed between the exhaust passage sections 34 and 36. The outer end of the exhaust passage section 34 is coupled to an appropriate engine exhaust system 40 while the inner end of the exhaust section 36 is open to the cylinder 18. Thus, with the exhaust rotary valve 38 in its open position, exhaust fumes from the fuel combustion are expelled through the exhaust passageway 32 and exhaust valve 38 during the conventional upward exhaust cycle of the piston 20.

Figure 4:
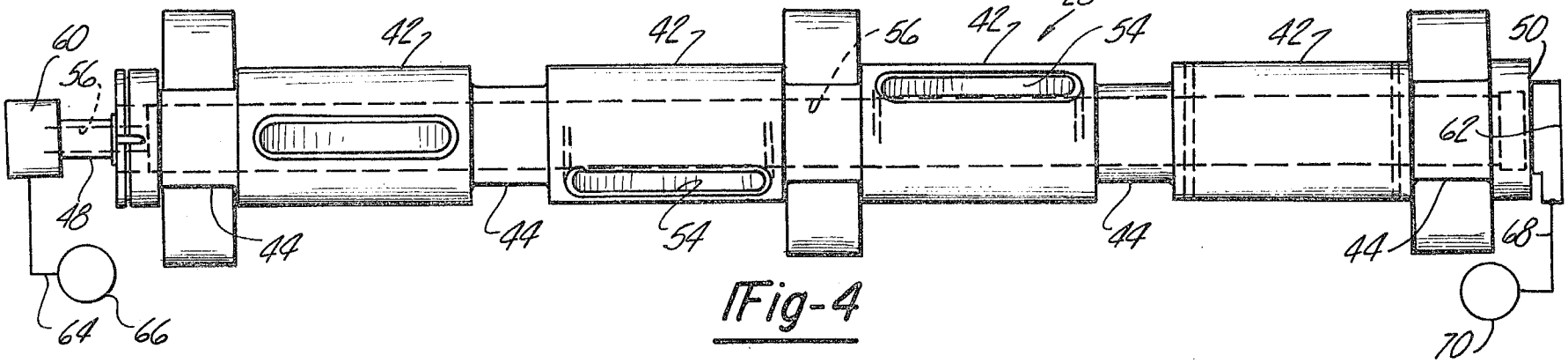
FIG. 4 is a side plan view showing the rotary valve of the present invention and enlarged for clarity.

With reference now to FIGS. 1, 2, and 4, the intake rotary valve 28 and exhaust rotary valve 38 are substantially identical to each other so that, for brevity, only the intake rotary valve 28 will be described in detail, it being understood, of course, that the description also applies to the exhaust rotary valve 38. The rotary valve 28 is elongated and cylindrical in cross-sectional shape and includes a cylindrical valve portion 42 respectively disposed in the intake passage means 22 for each cylinder 18. A reduced diameter portion 44 is formed between each adjacent pair of valve portions 42 and at each axial end of the rotary valve 28. Conventional bearing means 46 are positioned around the reduced diameter portions 44 of the valve 28 in the head assembly 16 so that the valve 28 can rotate in the head assembly 16 via the bearing means 46. The bearing means 46 can be constructed from a pair of inexpensive, semicircular shell halves typically made of brass or other malleable material. Since the valve portions 44 are of reduced diameter, the bearing means 46 also prevent axial displacement of the rotary valve 28 in the head assembly 16. The rear end 48 of the rotary valve 28 protrudes outwardly from the housing 12 while the other axial end 50 of the valve 28 protrudes into a cavity 52 (FIG. 3) formed in the housing 12.

As best shown in FIGS. 1 and 4, each valve portion 42 includes an axially oblong diametric throughbore 54 so that the valve 28 permits fluid communication between the intake passage sections 24 and 26 when the throughbore 54 is in alignment with the sections 24 and 26, as best shown in FIG. 1. Conversely, of course, the rotary valve 28 obstructs and prohibits fluid flow from the passage section 24 to the section 26 when the rotary valve 28 is rotated to a position in which the oblong throughbore 54 is not in registry with the passage sections 24 and 26. It will also be appreciated that the angular positions of the throughbores 54 relative to each other will vary from one valve portion 42 to the other as required by the cylinder combustion sequence of the particular internal combustion engine 10.

At least one, and preferably two, axial passageways 56 are formed entirely through the rotary valve 28 so that the axial passageway 56 is open at both axial ends 48 and 50 of the valve 28. The axial passageway 56 does not intersect or fluidly communicate with any of the oblong throughbores 54, but rather is formed around the walls 58 which define the oblong throughbores 54.

A rotary-type fluid connector 60 (FIG. 4) is attached to the rear axial end 48 of the rotary valve 28 while a like similar rotary-type fluid connector 62 is attached to the other axial end 50 of the rotary valve 28. By this, fluid communication is established from the fluid connector 60, through the axial passageway 56 and to the fluid connector 62 wherein the valve 28 can rotate relative to the fluid connectors 60 and 62 without interfering with the fluid connection of the connectors 60 and 62.

The fluid connector 60, in turn, is coupled by a line 64 to a source of pressurized coolant 66, typically the output of the engine water pump (not shown). Similarly, the other fluid connector 62 is fluidly coupled by a line 68 to the coolant reservoir 70, typically the radiator inlet of the cooling system (not shown) so that during engine operation, a continuous coolant flow is obtained through the axial passageway 56. Preferably, a protector cap 71 attached to the engine housing encloses and protects the rear end 48 of the rotary valve 28 with its attached fluid connector 60.

From the foregoing, it can be seen that during engine operation, a continuous coolant flow is established axially through the rotary valve 28 which simply, but effectively cools the rotary valve 28 and prevents it from warping due to overheating. Moreover, by use the highly efficient rotary valve cooling system as taught by the present invention, thermal expansion of the rotary valve 28 is virtually nonexistent which permits the use of relatively inexpensive bearing means 46, rather than high temperature bearing means as have been previously required for rotary valves.

With reference now particularly to FIGS. 2 and 3, the means for rotatably driving the intake and exhaust rotary valves 28 and 30, respectively, is thereshown and comprises a vertical shaft 72 having an upper end extending into and rotatably journalled within the cavity 52. The lower end of the shaft 72 is coupled with and rotatably driven by the crankshaft (not shown) for the engine 10.

A bevel gear 74 is secured to the upper end of the shaft 72 and meshes with a cooperating bevel gear 76 coupled to a stub shaft 78 and rotatably journalled by ball bearing means 80 within the housing cavity 52. Still referring to FIGS. 2 and 3, a small spur gear 82 is likewise coupled to the stub shaft 78 for rotation therewith immediately adjacent the bevel gear 76. The spur gear 82 in turn meshes with a pair of larger spur gears 84 secured onto the front end 50 of both the intake and exhaust valves 28 and 38, respectively. By this arrangement, rotation of the shaft 72 by the engine crankshaft in turn simultaneously rotatably drives both the intake and exhaust valves 28 and 38. It will also be appreciated that the proper gearing ratios between the gears 74, 76, and 82 and 84 will, of course, depend upon the particular type of internal combustion engine 10. For example, in a conventional four-cycle engine a one-half rotation of each rotary valve 28 and 30 would be required for every two rotations of the engine crankshaft. It will also be appreciated that the rotary valves 28 and 38 are rotatably driven in the opposite rotational directions, but due to the diametric nature of the oblong throughbores 54, the correct opening sequence for the valves 28 and 38 is obtained regardless of their direction of rotation.

With reference now to FIGS. 1 and 5, an improved seal 86 is thereshown for sealing the rotary valve 28 or 38 to the engine housing 12. One seal 86 is positioned between the rotary intake valve 28 and each intake passage section 24 and 26 and, likewise, one seal 86 is positioned between the exhaust rotary valve 38 and each exhaust passage sections 34 and 36. The seals 86 are all substantially identical so that, for brevity, only the inner exhaust valve seal 86 will be described in detail it being understood, of course, that a like description is applicable to the remaining rotary valve seals 86.

Each seal 86 includes a mounting member 88 which is tubular and oblong in cross-sectional shape and spread radially outwardly at one axial end 90 to form an annular oblong abutment flange 92. The abutment flange 92 is received within a like-shaped pocket 94 formed in the head assembly 16 around the exhaust passage section 36. The other axial end 96 of the member 88 faces and nearly abuts against the rotary valve 38. For this reason, the axial end 96 of the member 88 is machined arcuately at 97 to conform with the outer periphery of the rotary valve 38.

An oblong annular bearing 98 is disposed annularly around the outer periphery of and between the flange 92 and the end 96 of the mounting member 88 so that the mounting member 88 protects the bearing 98 from unwanted debris. One end 100 of the bearing 98 abuts against the rotary valve 38 and, for this reason, this end 100 is arcuately formed to thereby conform with the arcuate outer periphery of the rotary valve 38. A spring-type washer 102 is also disposed between the annular flange 92 of the mounting member 88 and the bearing 98. The spring washer 102 is under compression and thus urges the end 100 of the bearing 98 against the rotary valve 38 to provide a fluid-tight seal between the bearing 98, and hence the head assembly 16, and the rotary valve 38. Moreover, the bearing 98 is preferably made of graphite since graphite is self-lubricating which reduces the frictional wear and tear on the bearing 98 due to its rubbing contact with the valve member 38. In addition, any wear and tear of the graphite bearing 98 is automatically compensated for by the expansion by the spring 102.

Figure 6:
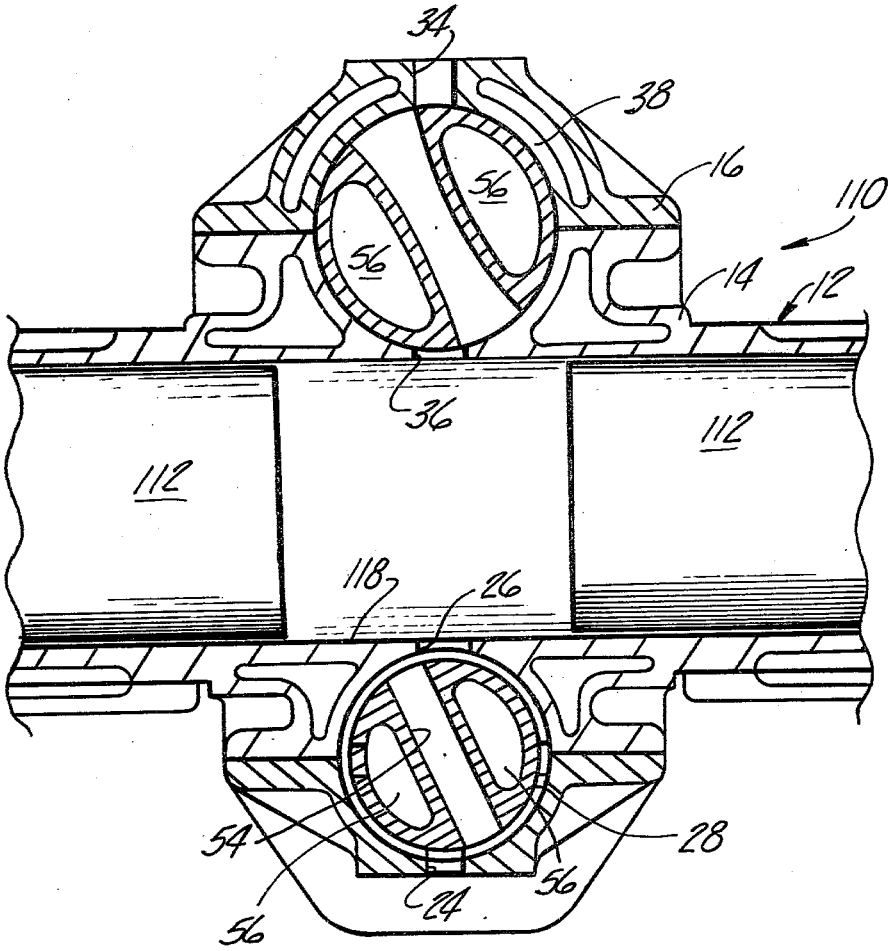
FIG. 6 is a fragmentary sectional view similar to FIG. 1, but showing the rotary valve of the present invention employed in a different type of internal combustion engine.

With reference now to FIG. 6, the rotary valves 28 and 38 according to the present invention are thereshown employed in an opposed piston engine 110 in which a pair of pistons 112 are slidably disposed in a single engine cylinder 118. Reciprocation of the pistons 112 within the cylinder 118, of course, rotatably drives the rotary valves 28 and 38 so that the intake valve 28 fluidly connects the intake passage sections 24 and 26 at predetermined rotational positions of the valve 28 while the exhaust rotary valve 38 likewise fluidly connects the exhaust passage sections 34 and 36 at predetermined rotational positions of the valve 38. Each rotary valve 28 and 38 includes at least one axial coolant passage 56 through which coolant flows to cool the rotary valves 28 and 38 in the manner as has been previously described. As should be apparent, the means for rotatably driving the valves 28 and 38 typically would be modified to conform to the particular opposed piston engine 110.

The rotary valve construction of the present invention thus achieves several important advantages over the previously-known rotary valves. In particular, the axial coolant passageways 56 in the valves 28 and 38 provide a simple and yet effective means for efficiently cooling the rotary valves. As such, the previously-known thermal expansion and warping of the rotary valves is effectively eliminated. By doing so, of course, relatively inexpensive bearing means can be used to rotatably journal the valves 28 and 38 rather than the expensive, high-temperature bearing assemblies that have been heretofore required. Moreover, the coolant flow through the passageways 56 also cools the bearing means to further preclude thermal expansion and warping of the bearing means.

In addition, the seal 86 between the engine housing 12 and the rotary valves 28 and 38 provides a simple and yet effective means for sealing the valve to the housing which is simple and low cost in construction. The seal 86, thus, prevents the previously-known compression loss and carburetor blow-back caused by leakage around the rotary valves. The seals 86 achieve the further advantage over the previously-known engine construction in that the bearing 98 is not only self-lubricating, but in addition, the spring washer 102 automatically compensates for the inevitable wear caused by the rubbing contact of the rotary valves against the graphite bearings.

Having described my invention, many modifications thereto will become apparent to those whose skill in the art to which it pertains without deviation from the spirit of the invention as defined by the appended claims.

I claim:

1. In an internal combustion engine of the type having a housing with at least one cylinder formed in said housing, at least one piston member reciprocally received in said cylinder, fuel intake passage means formed in said housing for communicating a combustible mixture to said cylinder, ignition means for igniting said combustible mixture in said cylinder, and exhaust passage means formed in said housing for expelling exhaust gases from said cylinder, the improvement which comprises:

a first and a second one-piece cylindrical valve member, each valve member having at least one throughbore formed substantially diametrically therethrough, means for rotatably mounting said first and second valve members in said intake passage means and exhaust passage means, respectively, so that each valve member establishes fluid communication through its respective passage means through its respective diametric throughbore at predetermined rotational positions of said valve members, means for rotatably driving said valve members in synchronism with the reciprocation of said piston member, wherein each valve member includes at least one axial fluid passageway, means for providing a flow of a fluid coolant through said axial passageway in each of said valve members wherein each valve member includes at least two axially spaced reduced diameter portions formed therealong and wherein said rotatable mounting means further comprises at least two bearing means contained within said housing and each bearing means being adapted to engage one of said reduced diameter portions of said valve member, and wherein each bearing means comprises a pair of one-piece semicircular shell halves, each of a pair of said semicircular shell halves being separately insertable into said housing and around one reduced diameter portion of said one-piece valve member.

2. The invention as defined in claim 1 wherein said rotatable driving means further comprises:

a pair of driven gears, one driven gear being coupled to one end of each valve member;

a shaft and means for rotatably driving one end of said shaft in synchronism with the reciprocation of said piston member in said cylinder; and gear means coupled to the other end of said shaft for simultaneously rotatably driving said driven gears.

3. The invention as defined in claim 1 and including sealing means for fluidly sealing said valve members to said engine housing.

4. The invention as defined in claim 3 wherein said sealing means further comprises a plurality of bearing members, each bearing member being contained in said engine housing, and resilient means for urging said bearing members against said rotary valves.

5. The invention as defined in claim 4 wherein each bearing members include a throughbore and is positioned in said intake and exhaust passage means and against said valve members so that each bearing member throughbore is in registry with one of said passage means.

6. The invention as defined in claim 5 and including a holder for supporting each bearing member, each of said holders having a tubular portion which extends through its respective bearing member throughbore.

7. The invention as defined in claim 6 wherein said resilient means is a spring washer positioned between each holder and its respective bearing member.

8. The invention as defined in claim 6 wherein each holder includes an annular flange at one axial end which is abuttingly received in a pocket formed in said housing.

9. The invention as defined in claim 4 wherein said bearing members are constructed of graphite.

10. The invention as defined in claim 1 wherein said internal combustion engine is an opposed piston engine having two piston members in each cylinder formed in said housing and wherein said intake passage means and said exhaust passage means fluidly communicate substantially with the axial midpoint of said cylinder.

11. The invention as defined in claim 1 wherein said axial passageway is formed axially around each radial side of each diametric throughbore.

12. The invention as defined in claim 11 wherein each diametric throughbore has an axially oblong cross-sectional shape.

13. In an internal combustion engine of the type having a housing with at least one cylinder formed in the housing, at least one piston member reciprocally received in said cylinder, passage means formed in said housing for communicating a combustible mixture to said cylinder and for expelling exhaust gases from said cylinder, and at least one cylindrical rotary valve means rotatably journalled in said housing and having a portion disposed in said passage means said rotary valve means portion having a diametric throughbore so that said rotary valve means selectively establishes fluid communication through said passage means at predetermined rotational positions of said rotary valve means, the improvement which comprises:

sealing means for fluidly sealing said rotary valve means to said housing, said sealing means further comprising a tubular holder having a throughbore and an outwardly extending flange at one end, said holder flange being positioned within a pocket formed in said engine housing adjacent the rotary valve means portion, said pocket having a base, said holder being of an axial length substantially the same as the pocket so that the other end of said holder lies closely adjacent the valve means portion and so that the holder throughbore registers with said valve portion throughbore at said predetermined rotational positions, a bearing element, said bearing element being annular in shape and disposed over and around said holder, a spring in a state of compression positioned between one axial end of the bearing element and the flange so that said spring urges the other axial end of said bearing element against said valve portion and simultaneously urges said holder flange against the base of the housing pocket to thereby retain said holder in place.

14. The invention as defined in claim 13 wherein said bearing member is constructed of graphite.

* * * * *